United States Patent [19]

Gillio

[11] Patent Number: 5,056,944

[45] Date of Patent: Oct. 15, 1991

[54] PAPER PRESSING ARRANGEMENT FOR TYPEWRITERS

[75] Inventor: Claudio Gillio, Borsso Canavese, Italy

[73] Assignee: Ing. C. Olivetti & C., S.p.A., Turin, Italy

[21] Appl. No.: 527,772

[22] Filed: May 24, 1990

[30] Foreign Application Priority Data

Jun. 14, 1989 [IT] Italy ..... 67480 A/89

[51] Int. Cl.[5] ..... B41J 13/02

[52] U.S. Cl. ..... 400/637; 400/637.5

[58] Field of Search ..... 400/637, 637.1, 637.2, 400/637.3, 637.4, 637.5, 637.6, 645.5, 639.1, 641

[56] References Cited

U.S. PATENT DOCUMENTS

| | | | |
|---|---|---|---|
| 2,331,120 | 10/1943 | Hill et al. | 400/637.5 |
| 4,179,224 | 12/1974 | Feldman et al. | 400/637 |
| 4,564,305 | 1/1986 | Rekewitz et al. | 400/636.3 |
| 4,592,670 | 1/1986 | Frank et al. | 400/637 |
| 4,607,968 | 8/1986 | Carena | 400/637 |
| 4,630,950 | 12/1986 | Chu et al. | 400/645.5 |
| 4,708,504 | 11/1987 | Asakura | 400/637 |
| 4,721,402 | 1/1988 | Nakajima | 400/637 |
| 4,887,922 | 12/1989 | Satake et al. | 400/637 |

FOREIGN PATENT DOCUMENTS

| | | | |
|---|---|---|---|
| 829896 | 7/1949 | Fed. Rep. of Germany | 400/637.5 |
| 2242220 | 3/1973 | Fed. Rep. of Germany | 400/637.2 |
| 3131750 | 5/1982 | Fed. Rep. of Germany | 400/637.6 |
| 3419257 | 11/1985 | Fed. Rep. of Germany | 400/637.1 |
| 917243 | 11/1945 | France | 400/637 |
| 215114 | 5/1924 | United Kingdom | 400/637 |

*Primary Examiner*—Eugene H. Eickholt

*Attorney, Agent, or Firm*—Banner, Birch, McKie & Beckett

[57] ABSTRACT

The paper pressing arrangement comprises a paper guide plate for guiding a sheet of paper around a platen roller towards the typing line. The paper guide plate comprises two conveyor modules each of which supports three paper pressing rollers and is provided with a pivot element projecting from the barycentre of the triangle joining the mid-points of the three rollers. A control mechanism, in an operative position, transmits by means of a rocker lever pivotally connected to the pivot elements the action of a spring to urge the conveyor modules against the roller. The control mechanism comprises a lever for positioning the two conveyor modules in an inoperative position to permit insection of the sheet of paper. Each conveyor module defines a first axis for rotation of two front paper pressing rollers and a second axis spaced from the first axis for rotation of a rear roller disposed intermediate each pair front rollers. The paper pressing rollers have a rotary shaft of plastics material and a covering of rubber. Each conveyor module comprises, for each paper pressing roller two depressed seats for accommodating the shaft without force, and a through slot positioned between the two depressed seats. The through slot is of a width which is slightly less than the diameter of the paper pressing roller so that, in mounting, the rubber covering on each roller has to be slightly forced into the slot to permit the ends of the shaft to reach the seats. Each paper pressing roller then remains restrained between the two seats and the respective slot and will be capable of slight axial and radial movements until it is positioned against the platen roller.

18 Claims, 2 Drawing Sheets

PAPER PRESSING ARRANGEMENT FOR TYPEWRITERS

BACKGROUND OF THE INVENTION

The present invention relates to a paper pressing arrangement for typewriters having a platen roller, the paper pressing arrangement including a paper guide plate for guiding a sheet of paper towards the typing line, said plate including at least two conveyor modules, paper pressing rollers carried by said conveyor modules for holding the sheet of paper against the roller, and a control mechanism having spring means for urging the conveyor modules into an operative position in which said conveyor modules are held against the platen roller parallel thereto.

DESCRIPTION OF THE PRIOR ART

U.S. Pat. No. 4,607,968 discloses a paper pressing arrangement of this type, in which each plate is pivotally mounted on a control shaft of a control mechanism, parallel to the axis of the roller and capable of preventing transverse movements of the plate with respect to the roller. A leaf spring of the control mechanism cooperates with a cam on the plate to hold the paper pressing rollers pressed against the platen roller. The control shaft comprises opening cams co-operable with the leaf springs to disengage the leaf springs from the respective cams and permit radial displacement with respect to the roller of the respective plate, so that the paper pressing rollers are disengaged from the roller to permit a sheet of paper to be introduced.

This paper pressing arrangement is reliable, functional and well suited to being mounted on typewriters of standard type. However the structure thereof is excessively expensive for portable typewriters in the medium-low range, in which costs must be kept as low as possible.

SUMMARY OF THE INVENTION

It is therefore an object of the invention to provide a paper pressing arrangement which is simple, easy to use and of very moderate cost.

In a first aspect the invention provides a paper pressing arrangement for typewriters having a platen roller defining a typing line. The paper pressing arrangement comprises a paper guide plate for guiding a sheet of paper towards said typing line, said plate including at least two conveyor modules. Paper pressing rollers carried by said conveyor modules hold the sheet of paper against said platen roller. A control mechanism includes spring means for urging said conveyor modules into an operative position in which said conveyor modules are held against said platen roller and parallel thereto and a pivot element for each said conveyor module, said pivot element being disposed in a substantially barycentric position with respect to said paper pressing rollers. A rocker lever has two ends pivotally connected to respective pivot elements of two said conveyor modules and, between its two ends, a central pivot. An actuating member is connected to said spring means and cooperates with said central pivot of said rocker lever so as to hold said conveyor modules in said operative position and to distribute uniformly the action of the spring means to said paper pressing rollers.

In a second aspect, the invention provides a paper pressing arrangement comprising a paper guide plate for guiding a sheet of paper towards the typing line, said plate including a series of conveyor modules disposed beneath said platen roller and a plurality of groups of paper pressing rollers, for holding said sheet of paper against said platen roller, each one of said plurality of groups being carried by a respective one of said series of conveyor modules. Said paper pressing rollers are mounted for rotation and disposed along two axes spaced from one another and extending parallel to said platen roller. Each said group of paper pressing rollers comprises two first sub-groups of rollers which are disposed along one of said two axes and a second sub-group of rollers which is disposed along the other of said two axes at intermediate positions between the positions of the rollers of said two first sub-groups of rollers.

In a further aspect, the invention provides a paper pressing arrangement comprising a paper guide plate for guiding a sheet of paper towards the typing line. Said paper guide plate includes a conveyor made of plastics material and paper pressing rollers for holding said sheet of paper against said platen roller. Each paper pressing roller has a shaft of plastics material and an elastomeric covering. Said conveyor comprises for each said paper pressing roller two seats which are depressed relative to a surface of said conveor facing said platen roller and which are capable of accommodating with play said shaft of plastic material, and a through slot disposed between said two seats; said slot being of a width which is slightly less than the diameter of said paper pressing roller. When being mounted in said seats said paper pressing roller has to be slightly forced into said slot, deforming the elastomeric covering, to permit the ends of said shaft to engage in said respective depressed seats.

BRIEF DESCRIPTION OF THE INVENTION

A preferred embodiment of the invention is set forth in the following description which is given by way of non-limiting example and with reference to the accompanying drawings in which:

FIG. 1 is a side view of part of a paper pressing arrangement according to the invention, FIG. 2 is a partial side view showing some details from the arrangement illustrated in FIG. 1, FIG. 3 is a partial longitudinal view of the arrangement shown in FIG. 1 on a different scale from FIGS. 1 and 2, and FIG. 4 is a partial plan view in section taken along line IV—IV in FIG. 1.

DETAILED DESCRIPTION OF A PREFERRED EMBODIMENT

Figure 1:
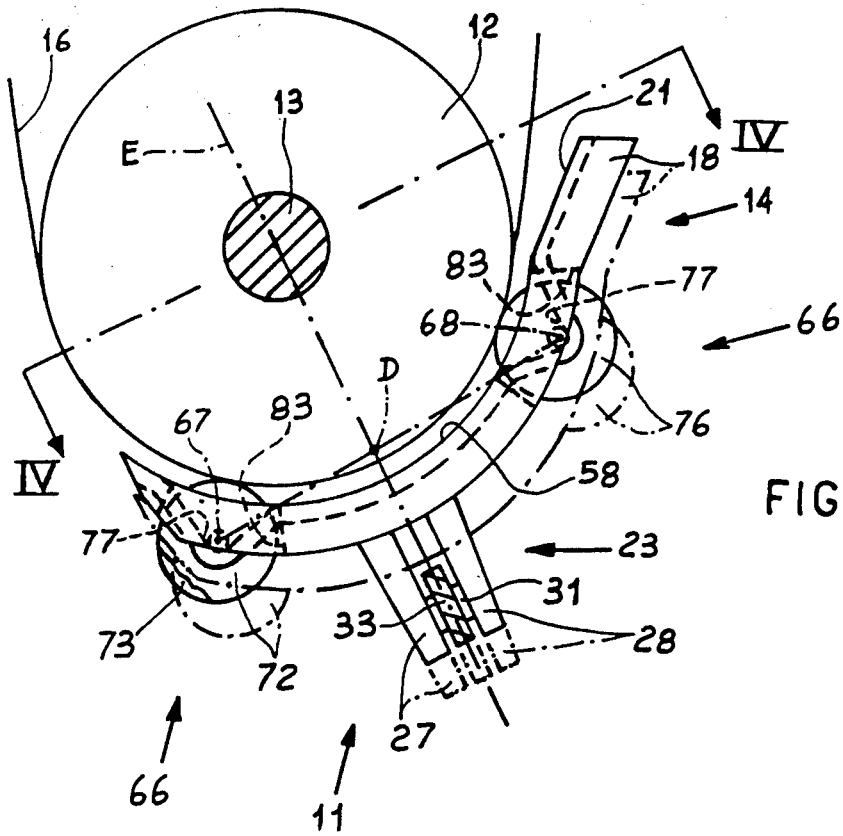
Figure 2:
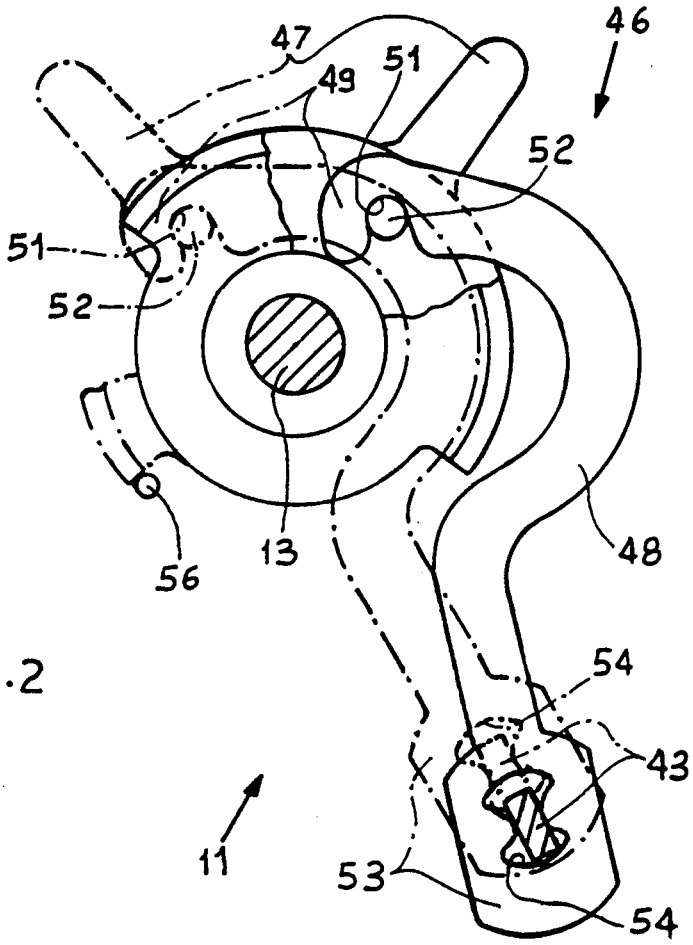
Figure 3:
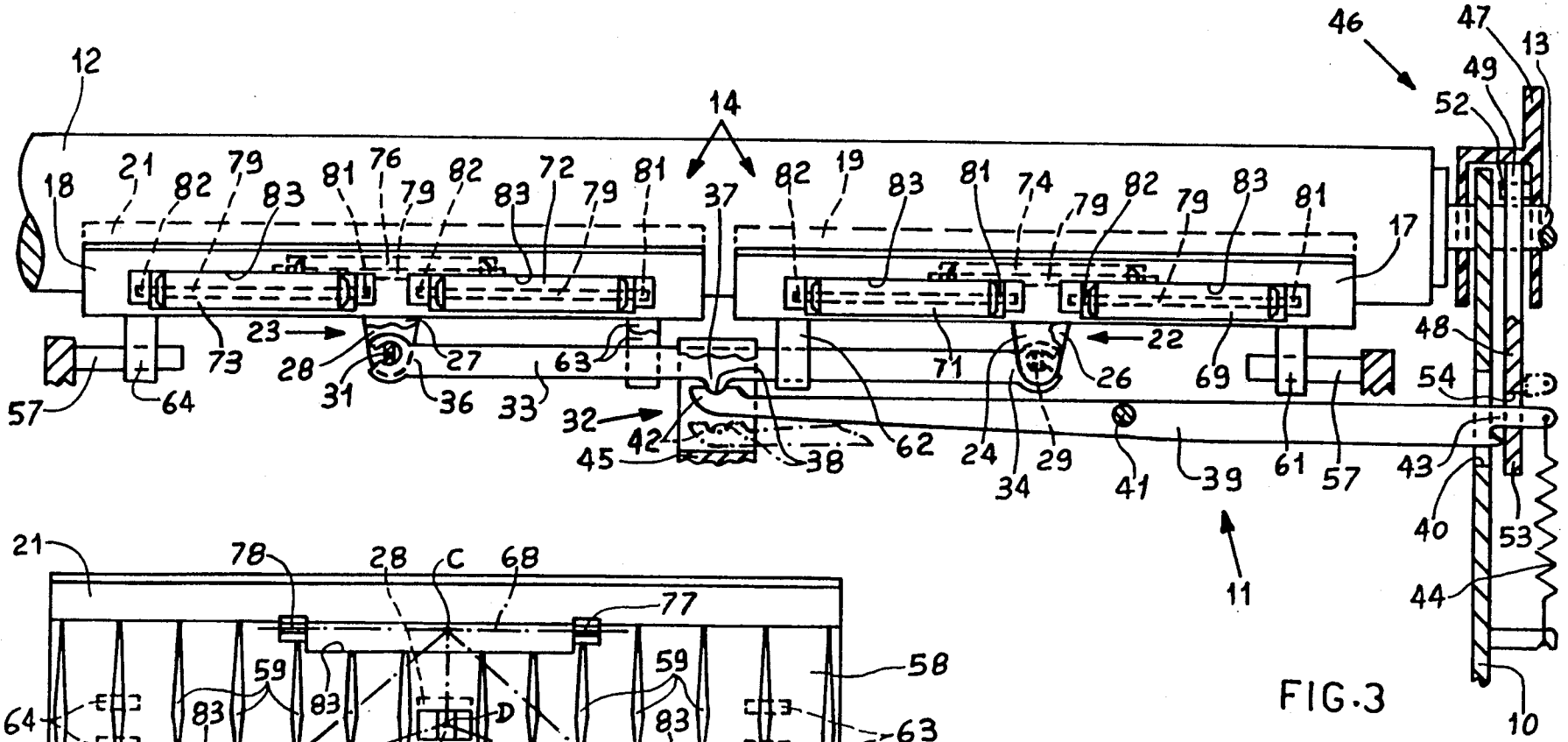
Figure 4:
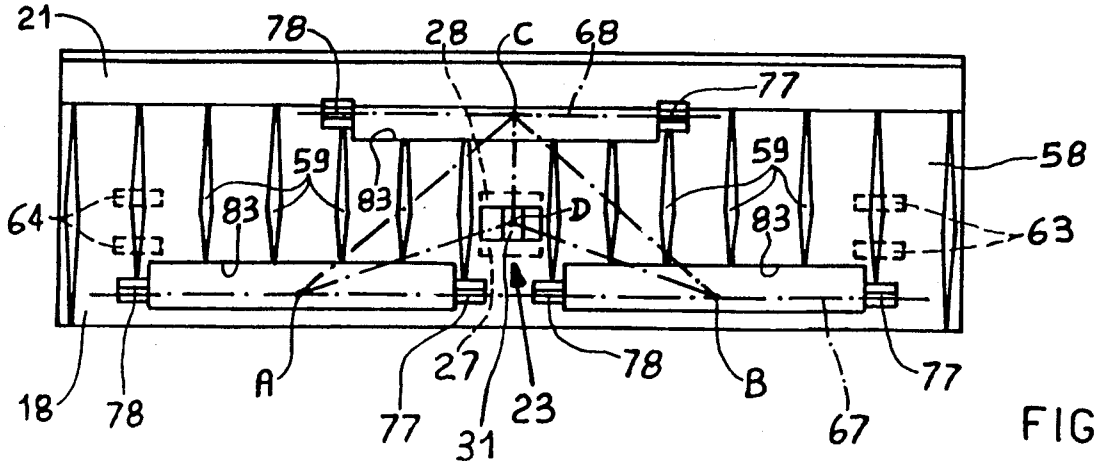

Referring to FIGS. 1, 2 and 3, a paper pressing arrangement according to the invention is generally identified by reference numeral 11 and is applied to a typewriter having a conventional platen roller 12 rotatable with a shaft 13 on a frame structure 10 of the machine in a manner which is known per se but not described and illustrated in order not to complicate the present description. The paper pressing arrangement 11 comprises a paper guide plate indicated at 14 for guiding a sheet of paper 16 around the roller 12 towards the typing line. The paper guide plate 14 comprises two conveyor modules 17 and 18 which are positioned below the platen roller 12 and which are identical to each other and in which each conveyor module 17,18 comprises a main body formed by a thin wall of substantially semicylindrical shape, connected at one end to a flat wall 19,21. Each conveyor module 17 and 18 has a pivot element as indicated at 22 and 23, projecting from a central position on the opposite side with respect to the platen roller 12. The pivot element comprises in particular a pin 29, 31 which is rigidly fixed between two limbs 24 and 26, and 27 and 28 respectively, which are fixed with respect to the modules 17 and 18.

A control mechanism indicated at 32 comprises a rocker lever 33 having two ends 34 and 36 which are pivotally connected by means of a press-type coupling to the pins 29 and 31 of the two conveyor modules 17 and 18. The rocker lever 33 comprises a central limb 37 between the two ends 34 and 36, having the free end of semicylindrical shape capable of being accommodated in a semicylindrical seat 38 of an actuating member 39 of the control mechanism 32. The actuating member 39 comprises a lever guided by a slot 40 in the frame structure 10 and is pivoted at an intermediate point thereof on a fixed pin 41 and has a first end 42 which defines the seat 38 and a second end 43 which carries the forces of spring means 44 of the control mechanism 32. The spring means 44 comprise a coil spring which is tensioned between the first end 43 and the frame structure 10 and which, by means of the actuating lever 39, loads the rocker lever 33 to hold the two conveyor modules 17 and 18 in an operative position in which the two conveyor modules 17 and 18 are pressed against the platen roller 12 parallel thereto. A fixed fork 45 guides and prevents transverse movements of the rocker lever 33 and the end 42 of the actuating lever 39. The control mechanism 32 comprises an opening assembly indicated at 46 for displacing the two conveyor modules 17 and 18 from the operative position in which the two conveyor modules 17 and 18 are against the platen roller 12, as shown in continuous lines in FIG. 1, to an inoperative position in which the two conveyor modules 17 and 18 are spaced from the platen roller 12 to permit insertion of the sheet of paper 16, as indicated by the dash-dotted lines in FIG. 1.

The opening assembly 46 (FIGS. 1, 2 and 3) comprises an opening lever 47 which is pivotally mounted on the shaft 13 of the platen roller 12 and a link 48 connected between the opening lever 47 and the actuating lever 39 of the control mechanism 32. The link 48 has one end 49 with a semicylindrical seat 51 capable of engaging with a pin 52 on the opening lever 47 and another end 53 with a suitably shaped slot 54 for accommodating with clearance the second end 43 of the actuating lever 39. The opening lever 47 is rotatable on the shaft 13 from a rest position shown in solid line in FIG. 2 to an operative position shown in dash-dotted lines by way of an intermediate neutral position. In its rest position the lever 47 does not act on the lever 39 and the spring 44 holds the two conveyor modules 17 and 18 in the operative position against the platen roller 12. In its operative position the lever 47, by way of the link 48, acts on the end 43 of the lever 39, against the force of the spring 44, holding the two conveyor modules 17 and 18 in the inoperative position in which they are spaced from the platen roller 12 while the spring 44 holds the opening lever 47 arrested against a fixed stop 56, as described in greater detail hereinafter. Each conveyor module 17 and 18 is normally supported and arrested against a respective fixed guide or support 57 (FIGS. 1, 2, 3 and 4) when it is in the inoperative position and comprises on the surface 58 which faces towards the platen roller 12, a series of mutually parallel sliding ribs 59 disposed in planes perpendicular to the platen roller 12 to limit the area of contact between the sheet of paper 16 and the respective conveyor modules 17 and 18. Each conveyor module 17 and 18 further comprises two forks 61, 62 and 63, 64 respectively which project on the side of the pivot element 22, 23 and which are parallel to each other and to the pivot element 22, 23. The two conveyor modules 17 and 18 being substantially identical, they are interchangeable with each other and each is formed by a single piece of plastics material. The two forks 61 and 62, 63 and 64 are positioned at the ends of the respective conveyor modules 17 and 18 to receive with play the rocker lever 33 and, when the conveyor module 17 and 18 is in the inoperative position, also the actuating lever 39 and also for accommodating the respective fixed guide 57 which guides and prevents transverse movements of the respective conveyor module 17, 18 with respect to the roller 12.

Each conveyor module 17 and 18 rotatably carries a group of paper pressing rollers which are indicated generally at 66 to hold the sheet of paper 16 clinging to the platen roller 12. The paper pressing rollers 66 are disposed along two axes 67 and 68 which are spaced from each other and which are parallel to the platen roller 12. The first axis 67 is positioned at a front angular position which is more closely adjacent to the typing line while the second axis is positioned at a rear angular position which is further away from the typing line. The paper pressing rollers 66 of each conveyor module 17 and 18 comprise two first rollers 69 and 71, 72 and 73 disposed along the first axis 67 and spaced from each other, and a second roller 74, 76 disposed along the second axis 68 at an intermediate position between the position of the first rollers 69 and 71, and 72 and 73 respectively. Therefore the conveyor module 17 rotatably carries two front rollers 69 and 71 and a rear roller 74 and the conveyor module 18 rotatably carries two front rollers 72 and 73 and a rear roller 76.

Each conveyor module 17 and 18 has for each roller 69, 71, 72, 73, 74 and 76, guide support means comprising two seats 77 and 78 which are depressed with respect to the surface 58 facing towards the platen roller 12. The two depressed seats 77 and 78 are positioned along the two front and rear axes 67 and 68 and each seat 77, 78 is of a semicylindrical shape open upwardly towards the platen roller 12 and defining the axis 67 or 68. Each paper pressing roller 69, 71, 72, 73, 74 and 76 is of elastomeric material, mounted on a shaft 79 of plastics material and having the ends 81 and 82 projecting from the roller, being capable of being accommodated with play in the respective seats 77 and 78. Finally each conveyor module 17 and 18 is provided, for each paper pressing roller 69, 71, 72, 73, 74 and 76, with a through slot 83 positioned between the two seats 77 and 78 and being of a length which is slightly less than the external diameter of the respective paper pressing roller 69, 71, 72, 73, 74 and 76 in such a way that, in the mounting seats, each paper pressing roller 69, 71, 72, 73, 74 and 76 has to be slightly forced into the respective slot 83 in order subsequently to be able to engage with the ends 81 and 82 of the shaft 79 in the respective seats 77 and 78. Each paper pressing roller 69, 71, 72, 73, 74 and 76, when fitted to the respective conveyor module 17,18 is thus restrained with respect to the module but can move with slight axial and radial movements with respect to the two seats 77 and 78 and the respective slot 83. That permits the two conveyor modules 17 and 18 to be positioned in the operative position in which the paper pressing rollers 69, 71, 72, 73, 74 and 76 are against the external surface of the platen roller 12. The six paper pressing rollers 69, 71, 72, 73, 74 and 76 are substantially identical to each other and can be mounted on each conveyor module 17, 18 either at the front or at the rear.

The mode of operation of the paper pressing arrangement 11 is as follows:

In the rest position of the opening lever 47, the tension of the spring 44 of the control mechanism 32, by means of the actuating lever 39, holds the rocker lever 33 in a raised position and the two conveyor modules 17 and 18 are in the operative positions in which the paper pressing rollers 69, 71, 72, 73, 74 and 76 are against the external surface of the platen roller 12.

When the sheet of paper 16 is to be inserted, the operator manually rotates the opening lever 47 in the anti-clockwise direction from the rest position to the operative position. Due to the effect of that selection, the link 48 raises the end 43 of the actuating lever 39 against the force of the spring 44 until the neutral point of the spring 44 on the lever 47 is reached, and the lever 39 is rotated in the anti-clockwise direction and moves its end 42 downwardly. That is followed by downward movement due to the force of gravity of the rocker lever 33 and the two conveyor modules 17 and 18 with a radial motion with respect to the platen roller 12. In that way the front paper pressing rollers 69, 71, 72 and 73 and the rear paper pressing rollers 74 and 76 are disengaged from the platen roller 12 until the two conveyor modules 17 and 18 stop against the fixed support 57 in the inoperative position. When the neutral position has been exceeded, the operator can release the lever 47 and the spring 44 will in fact urge the opening lever 47 by means of an anti-clockwise rotary movement into its operative position in which it is arrested against the fixed stop 56.

The operator can now introduce the sheet of paper 16 and move the opening lever 47 from the operative position to the rest position. When the neutral position has been exceeded, the tension of the spring 44 now causes the actuating lever 39 to rotate in the clockwise direction, whereby the rocker lever 33 is raised. The two conveyor modules 17 and 18 are again moved into the operative position in such a way that the front paper pressing rollers 69, 71, 72 and 73 and the rear paper pressing rollers 74 and 76 can hold the sheet of paper 16 against the platen roller 12. The machine is thus again ready for typing. The action of the spring 44, by means of the actuating lever 39 and the rocker lever 33 which is pivotally connected by the ends 34 and 36 to the pins 29 and 31 of the pivot elements 22 and 23, is converted into a pressure force which is distributed in equal amounts to the two conveyor modules 17 and 18 and from those is applied to the platen roller 12, equally distributed among the front paper pressing rollers 69, 71 and 72, 73 respectively and the rear paper pressing rollers 74 and 76. For that purpose the pivot element 23 is substantially aligned along a line E perpendicular to the axis 13 of the roller 12, with the barycentre D of the triangle which connects centres A, B and C of the respective front paper pressing rollers 69, 71, 72 and 73 and the rear paper pressing rollers 74 and 76, as shown in dash-dotted lines in FIG. 4. In particular the centres A and B are on the front axis 67 and the centre C is on the rear axis 68, as shown by the dash-dotted line, and the axis E in FIG. 1 is substantially perpendicular to the plane IV—IV joining the points A, B and C and on which the barycentre D is disposed. With that structure the pressure force is applied to a barycentric position between the paper pressing rollers. The fact that each conveyor module 17 and 18 has only three paper pressing rollers, two front rollers 69 and 71 and 72 and 73 respectively, and a rear roller 74, 76 respectively, ensures uniform distribution of the pressure, even in the event of slight misalignments in respect of the two depressed seats 77 and 78 with respect to the theoretical axes 67 and 68.

It will be appreciated that the above-described paper pressing arrangement 11 may be the subject of various modifications and additions of parts without departing from the scope of the present invention.

What I claim is:

1. A paper pressing arrangement for typewriters having a platen roller defining a typing line, the paper pressing arrangement comprising:

a paper guide plate for guiding a sheet of paper towards said typing line, said plate including at least two conveyor modules;

paper pressing rollers carried by said conveyor modules for holding the sheet of paper against said platen roller; and a control mechanism including:

spring means for urging said conveyor modules into an operative position in which said conveyor modules are held against said platen roller and parallel thereto;

a pivot element for each said conveyor module, said pivot element being disposed in a substantially barycentric position with respect to said paper pressing rollers;

a rocker lever having two ends pivotally connected to respective pivot elements of two said conveyor modules and, between its two ends, a central pivot; and an actuating member connected to said spring means and cooperable with said central pivot of said rocker lever so as to hold said conveyor modules in said operative position and to distribute uniformly the action of the spring means to said paper pressing rollers.

2. The invention as set forth in claim 1 wherein said actuating member comprises a lever pivoted on a fixed pin and actuated by said spring means.

3. The invention set forth in claim 2 wherein said central pivot of said rocker lever comprises a semicylindrical surface capable of being accommodated in a corresponding seat (38) defined in a first end of said actuating lever, and wherein said spring means comprise a spring connected to a second end of said actuating lever.

4. The invention set forth in claim 3 wherein each said conveyor module is positioned beneath said platen roller and is of a substantially semicylindrical shape, said pivot element is disposed between two limbs projecting from a central portion of said conveyor module on the opposite side thereof to said platen roller, and wherein said pivot element is pivotally coupled to one of the two ends of said rocker lever and is substantially aligned with the barycentre with respect to a line perpendicular to the axis of said platen roller which passes through said barycentre of a triangle which connects the centres of said paper pressing rollers.

5. The invention set forth in claim 1 wherein said control mechanism further comprises an opening assembly including an opening lever for moving said two conveyor modules from the operative position through a neutral position of said spring means on said opening lever to an inoperative position in which said two conveyor modules are spaced from said platen roller so as to permit the insertion of a sheet of paper.

6. The invention set forth in claim 5 wherein the opening lever is pivoted on a shaft of said platen roller and the opening assembly comprises a link disposed between said opening lever and said actuating lever and wherein said opening lever is movable from a rest position in which said spring means holds said two conveyor modules in the operative position to an operative position of said opening lever in which said conveyor modules are held in the inoperative position and said spring means holds said opening lever arrested against a fixed stop.

7. The invention set forth in claim 6 wherein said link has a first end with a seat capable of engaging with a pin of said opening lever and a second end with a slot for accommodating with play the second end of said actuating lever.

8. The invention set forth in claim 1 wherein said pivot element comprises a notched pin having a portion of reduced cross-section and the ends of said rocker lever each comprise a circular seat connectable to said notched pin and provided with an opening for said portion of reduced cross-section to pass therethrough.

9. The invention set forth in claim 1 comprising a fixed fork for guiding movement of said rocker lever and said actuating member.

10. The invention set forth in claim 1 wherein each conveyor module comprises two forks one projecting on each side of the pivot element and aligned with each other and with said pivot element, and positioned adjacent the ends of the conveyor module and wherein a first fork of each conveyor module is capable of accommodating with play said rocker lever and, when each conveyor module is in its inoperative position, also said actuating member.

11. The invention set forth in claim 10 wherein a second fork of each conveyor module is co-operable with a fixed pin to define a plane of movement of said conveyor modules, passing through the axis of the platen roller.

12. The invention set forth in claim 11 wherein said two conveyor modules are substantially identical and interchangeable with each other.

13. A paper pressing arrangement for typewriters having a platen roller defining a typing line, the paper pressing arrangement comprising:

a paper guide plate for guiding a sheet of paper towards the typing line, said paper guide plate including a conveyor made of plastics material; and paper pressing rollers for holding said sheet of paper against said platen roller; each paper pressing roller including a shaft of plastics material and an elastomeric covering;

said conveyor comprising for each said paper pressing roller two seats which are depressed relative to a surface of said conveor facing said platen roller and which are capable of accommodating with play said shaft of plastic material, and a through slot disposed between said two seats; said slot being of a width which is slightly less than the diameter of said paper pressing roller;

whereby when being mounted in said seats said paper pressing roller has to be slightly forced into said slot, deforming the elastomeric covering, to permit the ends of said shaft to engage in said respective depressed seats.

14. The invention set forth in claim 13 wherein each depressed seat is of a semicylindrical shape which is open towards said platen roller (12) and wherein each paper pressing roller is movable with slight axial and radial movements between the two seats and the respective slot until it is positioned against said platen roller.

15. A paper pressing arrangement for typewriters having a platen roller defining a typing line, the paper pressing arrangement comprising:

a paper guide plate for guiding a sheet of paper towards said typing line, said plate including a series of conveyor modules disposed beneath said platen roller; and a plurality of groups of paper pressing rollers, for holding said sheet of paper against said platen roller, each one of said plurality of groups being carried by a respective one of said series of conveyor modules; said paper pressing rollers being mounted for rotation and disposed along two axes spaced from one another and extending parallel to said platen roller;

wherein each said group of paper pressing rollers comprises two first sub-groups of rollers which are disposed along one of said two axes and a second sub-group of rollers which is disposed along the other said two axes at intermediate positions between the positions of the rollers of said two first sub-groups of rollers;

wherein each of said two first sub-groups comprises two single rollers which are spaced from each other and positioned along one of said two axes, said second sub-group comprises a single roller positioned on said other axis, and wherein said one of said two axes is disposed forwardly of said roller, adjacent the typing line, and said other axis is disposed beneath said platen roller, remote from the typing line;

wherein each said conveyor module comprises support and guide means positioned along said two axes to support and guide said two single rollers and said second single roller and wherein said support and guide means comprise for each roller two seats which are depressed with respect to the surface of said support and guide means facing towards the platen roller;

wherein each paper pressing roller is mounted on a shaft of plastic material having its ends projecting from said roller, said ends being capable of being accommodated with play in said two recessed seats and wherein each recessed seat is of a shape which is open towards said platen roller.

16. A paper pressing arrangement for typewriters having a platen roller defining a typing line, the paper pressing arrangement comprising:

a paper guide plate for guiding a sheet of paper towards said typing line, said plate including a series of conveyor modules disposed beneath said platen roller; and a plurality of groups of paper pressing rollers, for holding said sheet of paper against said platen roller, each one of said plurality of groups being carried by a respective one of said series of conveyor modules; said paper pressing rollers being mounted for rotation and disposed along two axes spaced from one another and extending parallel to said platen roller;

wherein each said group of paper pressing rollers comprises two first sub-groups of rollers which are disposed along one of said two axes and a second sub-group of rollers which is disposed along the other of said two axes;

wherein each of said first sub-groups comprises two single rollers which are spaced from each other and positioned along one of said two axes, said second sub-group comprises a single roller positioned on said other axis, said one of said two axes is disposed forwardly of said platen roller, adjacent the typing line, and said other axis is disposed beneath said platen roller, remote from the typing line; and wherein each one of said series of conveyor modules carries said two single rollers positioned spaced from each other along one axis and said single roller disposed along said other axis and positioned at an intermediate position between the positions of said two single rollers.

17. The invention set forth in claim 16 wherein each said conveyor module comprises support and guide means positioned along said two axes to support and guide said two single rollers and said second single roller and wherein said support and guide means comprise for each roller two seats which are depressed with respect to the surface of said support and guide means facing towards the platen roller.

18. A paper pressing arrangement for typewriters having a platen roller defining a typing line, the paper pressing arrangement comprising:

a paper guide plate for guiding a sheet of paper towards said typing line, said plate including a series of conveyor modules disposed beneath said platen roller; and a plurality of groups of paper pressing rollers, for holding said sheet of paper against said platen roller, each one of said plurality of groups being carried by a respective one of said series of conveyor modules; said paper pressing rollers being mounted for rotation and disposed along two axes spaced from one another and extending parallel to said platen roller;

wherein each said group of paper pressing rollers comprises two first sub-groups of rollers which are disposed along one of said two axes and a second sub-group of rollers which is disposed along the other said two axes at intermediate positions between the positions of the rollers of said two first sub-groups of rollers;

wherein each of said two first sub-groups is constituted by two single rollers which are spaced from each other and positioned along one of said two axes, and said second sub-group is constituted by a single roller positioned on said other axis at an intermediate position between the positions of said two single rollers; and wherein said one of said two axes is disposed forwardly of said platen roller, adjacent the typing line, and said other axis is disposed beneath said platen roller, remote from the typing line.

* * * * *